US008869484B2

(12) United States Patent
Gulbrandsen et al.

(10) Patent No.: US 8,869,484 B2
(45) Date of Patent: Oct. 28, 2014

(54) FLEXIBLE DRYWALL GRID MEMBER FOR FRAMING DRYWALL STRUCTURES

(71) Applicant: USG Interiors, LLC, Chicago, IL (US)

(72) Inventors: Peder Gulbrandsen, Aurora, IL (US); Abraham M. Underkofler, Waukegan, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/674,983

(22) Filed: Nov. 13, 2012

(65) Prior Publication Data

US 2014/0130436 A1 May 15, 2014

(51) Int. Cl.
*E04B 1/32* (2006.01)
*E04B 9/00* (2006.01)

(52) U.S. Cl.
USPC ..... 52/506.07; 52/245; 52/86

(58) Field of Classification Search
USPC ..... 52/506.07–506.1, 245, 246, 86–89
See application file for complete search history.

(56) References Cited

U.S. PATENT DOCUMENTS

| | | | | |
|---|---|---|---|---|
| 3,016,585 | A * | 1/1962 | Chial | 52/473 |
| 3,053,358 | A * | 9/1962 | Gross | 52/696 |
| 3,206,888 | A | 9/1965 | Litzka | |
| 3,260,022 | A | 7/1966 | Guyer et al. | |
| 3,457,688 | A | 7/1969 | Znamirowski et al. | |
| 4,783,946 | A * | 11/1988 | Boegle | 52/506.1 |
| 5,119,587 | A | 6/1992 | Waltz | |
| 5,347,783 | A | 9/1994 | Frecska et al. | |
| 5,349,803 | A | 9/1994 | Nute, Jr. | |
| 5,590,493 | A | 1/1997 | Wilson | |
| 5,671,583 | A | 9/1997 | Turner | |
| 6,047,512 | A | 4/2000 | Wendt et al. | |
| 6,138,425 | A * | 10/2000 | Wendt | 52/506.07 |
| 6,374,564 | B1 | 4/2002 | Fletterick et al. | |
| 6,751,922 | B1 * | 6/2004 | Auriemma | 52/506.05 |
| 6,901,707 | B2 | 6/2005 | Smerud | |
| 6,957,517 | B2 * | 10/2005 | Auriemma | 52/506.07 |
| 7,293,392 | B2 | 11/2007 | Krumbacher | |
| 7,458,188 | B2 | 12/2008 | Mears | |
| 7,669,374 | B2 * | 3/2010 | Miller et al. | 52/506.07 |
| 7,712,262 | B2 | 5/2010 | Scanlan | |

(Continued)

FOREIGN PATENT DOCUMENTS

WO 02/06603 A1 1/2002

OTHER PUBLICATIONS

International Search Report and Written Opinion of the International Searching Authority dated Feb. 14, 2014 for PCT/US2013/068251, filed Nov. 4, 2013.

*Primary Examiner* — Elizabeth A Plummer
(74) *Attorney, Agent, or Firm* — Pearne & Gordon LLP

(57) ABSTRACT

A curvable grid tee for suspending drywall capable of being configured vertically into convex or concave shapes comprising a series of identical web segments joined end-to-end, the segments being formed of sheet metal into a tee shaped cross section, the sheet metal of a segment being folded such that each segment has a vertical double layer stem with the stem layers joined at a common fold at upper edges thereof, the sheet metal at lower edges of each layer of the stem being bent outwardly to form a flange, a junction between adjacent segments permitting such adjacent segments to be angularly displaced relative to one another in a vertical plane such that the flanges are capable of supporting a drywall panel in a curved plane.

6 Claims, 4 Drawing Sheets

(56) References Cited

U.S. PATENT DOCUMENTS

| | | | | |
|---|---|---|---|---|
| 7,752,821 | B2 | 7/2010 | Jankovec et al. | |
| 7,941,983 | B2 | 5/2011 | Wheeler | |
| 8,006,454 | B2 | 8/2011 | Jankovec et al. | |
| 8,453,403 | B2 * | 6/2013 | Wheeler | 52/246 |
| 2008/0115427 | A1 | 5/2008 | Wheeler | |
| 2009/0183460 | A1 | 7/2009 | Wheeler | |
| 2010/0095606 | A1 | 4/2010 | Bankston | |

* cited by examiner

FLEXIBLE DRYWALL GRID MEMBER FOR FRAMING DRYWALL STRUCTURES

BACKGROUND OF THE INVENTION

The invention relates to grid members of adjustable curvature for constructing curved drywall ceilings.

PRIOR ART

Architects, interior designers, building owners and/or tenants from time to time specify curved ceilings for obtaining a desired look that distinguishes a room or space from the utilitarian appearance of a flat ceiling. The radii of curvature ordinarily varies from site to site and can even vary at a particular site. This variety makes it impractical for manufacturers to produce and inventory an array of grid tees that could correspond to the possible arched ceilings that might be specified.

On site fabrication of framework for a curved drywall ceiling can require a high level of skill and extensive man hours making such ceiling construction relatively expensive.

There is a need for manufactured grid members capable of reducing labor costs and required skill and that can be used for a full range of curvatures.

SUMMARY OF THE INVENTION

The invention provides a manufactured, field adjustable grid tee for use in constructing curved drywall ceilings. The tee can be formed in concave shapes to construct vaults or convex shapes to construct convex ceiling areas. The inventive tees can be arranged in parallel rows and be joined by conventional cross tees to form a non-planar grid to which drywall sheets can be attached. The invention can take various forms including versions that can be locked in an adjusted position with a screw fastener. Other configurations of the inventive tee can be permanently bent into a desired configuration. The stem or spine of the disclosed tees is provided with apertures to enable the tee to be suspended with hanger wires in the customary manner a flat ceiling grid is suspended.

The tees are formed of sheet metal segments folded into a double layer stem and opposed flanges. The segments, which can be separate elements, initially joined elements or permanently joined elements, are arranged end-to-end. A curvature is imparted to the tee by causing the segments to become slightly angularly oriented to their adjacent segments. In some versions, the segments are assembled with a separate longitudinally continuous face strip, typically of sheet metal.

DESCRIPTION OF THE PREFERRED EMBODIMENT

Figure 1:
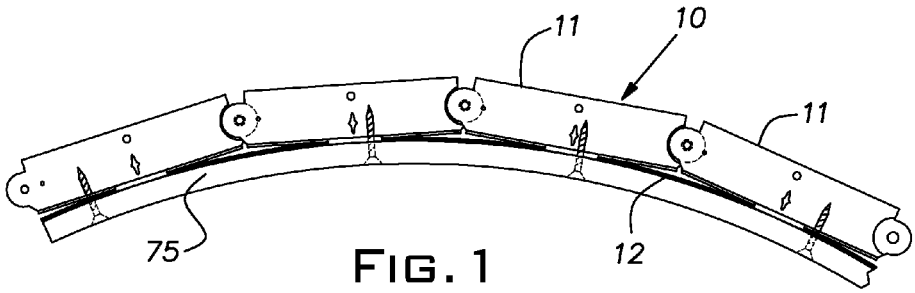
FIG. 1 is a fragmentary side view of a first embodiment of the tee of the invention with a sheet of drywall attached thereto in a concave or vault configuration.
Figure 2:
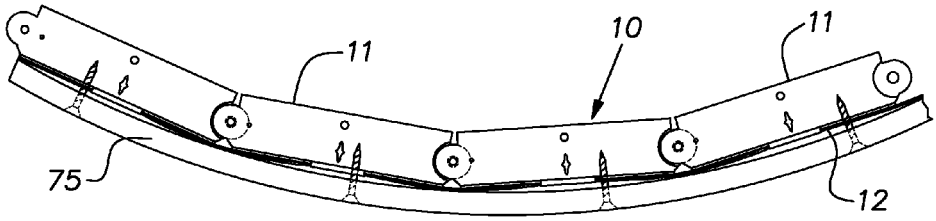
FIG. 2 is a fragmentary view of the tee of FIG. 1 in a convex configuration.
Figure 4:
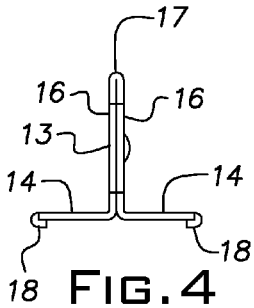
FIG. 4 is an end view of the segment of FIG. 3.
Figure 3:
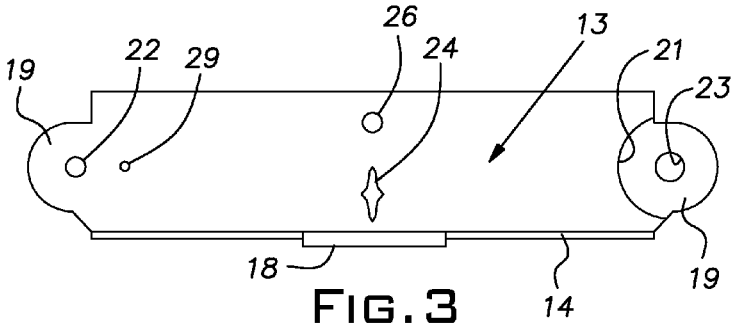
FIG. 3 is a side view of a single segment of the tee of FIG. 1.
Figure 5:
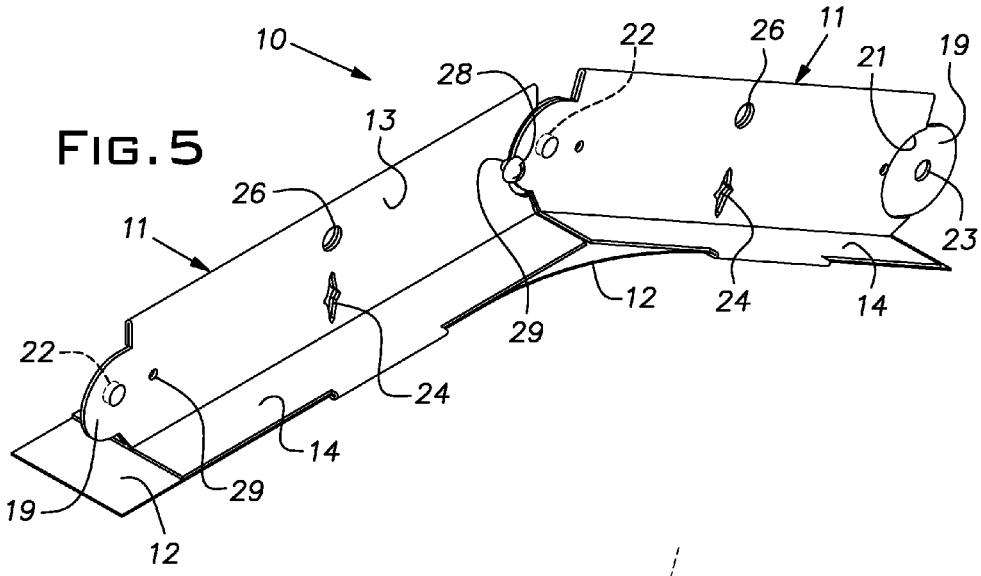
FIG. 5 is a fragmentary perspective view of the tee of FIG. 1.

The various tees described herein are manufactured from hot dipped galvanized sheet metal of, for example, between 28 and 22 gauge. The disclosed tees or runners are curvable in the sense that they are typically manufactured with a straight line configuration and are manually reconfigured into a desired curve in a vertical plane on the site where they are to be installed. The disclosed tees are analogous to conventional main tees used in suspended ceiling systems and can have a length of, for example, 10 feet.

Referring now to FIGS. 1-5, a curvable tee 10 comprises a series of identical segments 11 joined end-to-end and an elongated face strip 12 assembled on the segments. The segments 11 are stamped with the illustrated edge profile. A segment 11 has the cross section of an inverted tee with a vertical stem 13 and horizontal flanges 14. The stem 13 is formed with two layers 16 by bending the sheet stock through 180 degrees at an upper edge 17 of the stem 13. At a lower edge of the stem 13, each of its layers 16 is bent 90 degrees to form the flanges 14. At their mid-lengths, each flange 14 has a tab 18 folded under the main part of the respective flange 14 in the manner of a hem to capture the face strip 12 against the flange 14. The tabs 18 are sufficiently loose to allow local relative longitudinal sliding movement between the strip 12 and the segment 11. Viewed from above, the segment 11 has rotation symmetry with one stem layer 16 having the semi-circular projection 19 while the other layer 16 has the projection 19 at the opposite end.

The layer 16 not having the projection at the segment end has a semi-circular notch or cut-out 21 proportioned to receive a projection 19 of an adjoining segment 11.

The geometric center of a projection or tongue 19 at one end of a segment 11 is stamped into an integral rivet 22 which is received in a hole 23 punched into the geometric center of a projection 19 of an adjoining segment 11. Once positioned in a receiving hole 23, the rivet 22 can be upset to permanently couple the respective segments 11 together.

The face strip 12 is longitudinally continuous along the full length of the tee 10 and is assembled within the tabs 18 of all of the segments 11. Both layers 16 of the stem 13 are formed with aligned vertical slots 24 adapted to receive a pair of connectors of conventional drywall cross tees, one from each side of the tee 10. Similarly, aligned holes 26 sufficiently large to receive a hanger wire are also formed in the stem layers 16 adjacent its upper edge, designated 27.

A sheet metal screw 28 is assembled in a hole 29 in the stem layer 16 forming the rivet 22. The hole 29 is tangent to the circular edge of the mating projection 19 of the adjacent segment 11. The tee 10 can be infinitely adjusted, between limits, to any desired curvature concave or convex with reference to the plane of the stems 13. By way of example, the tee 10 (as well as other embodiments of the tee disclosed hereinbelow) can be placed against a pattern to obtain a desired arc. The tee 10 adjusts to a tangent with the desired curve by an angular displacement between each segment pair about the center of the respective rivet 22. The segments 11 are locked in their desired positions by tightening the set screws 28. After its curvature has been established the tee 10 can be suspended with wires assembled through the holes 26 provided in the stems 13. The center location of the stem 13, in the lateral direction of the tee 10, improves the stability of the tee 10 when it is suspended and allows the use of conventional cross tees used in drywall ceilings.

Figure 6:
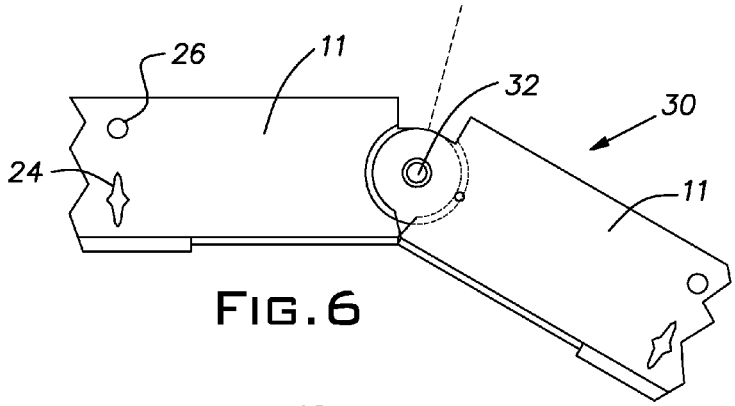
FIG. 6 is a fragmentary side view of a modification of the tee of FIG. 1.
Figure 7:
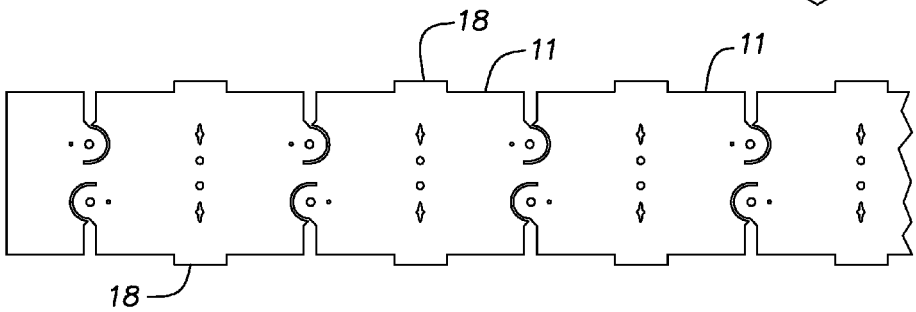
FIG. 7 is a plane view of an intermediate sheet metal blank from which the tee of FIG. 6 is produced.

FIGS. 6 and 7 illustrate a curvable tee 30 that is a modification of the tee 10 illustrated in FIGS. 1-5. The same numerals for the same or essentially the same parts and/or function are used in this modification. The stem 13 and flanges 14 are stamped or otherwise formed from a single strip of sheet metal stock illustrated in FIG. 7. In an initial manufactured state adjacent segments 11 are joined in the upper region of their stems 13. This condition can simplify manufacturing processes since individual segments 11 do not have to be individually positioned for assembly. A separate screw or rivet 32 can provide a pivot point for the segments 11 or an integral rivet 22 as described in the embodiment of FIGS. 1-5 can be employed. The stem or spline 13 can be cut-out at a subsequent manufacturing step after a pivoted joint is established or can be field cut by the technician prior to installation of the tee 30 in a grid. If, rather than a simple cut, a small section of the top area of the adjoining stems 13 above the pivot center is removed, the tee 30 can be curved in a convex configuration.

Figure 8:
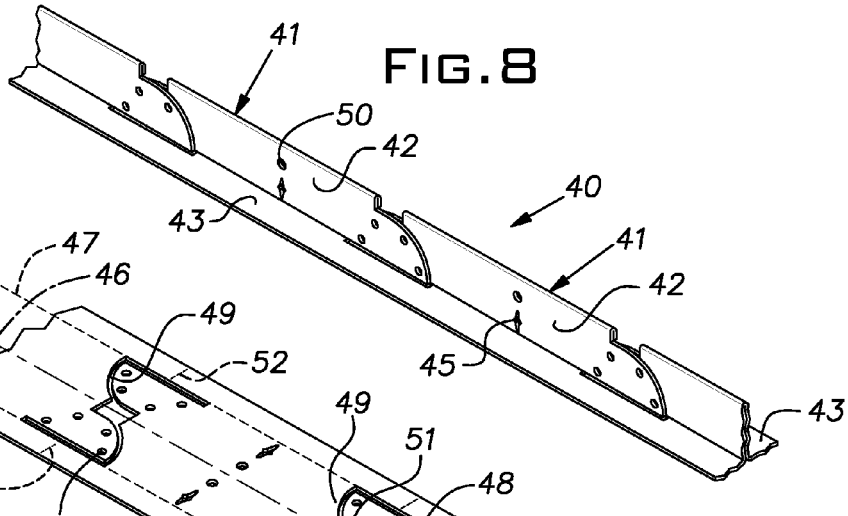
FIG. 8 is a fragmentary perspective view of a second version of the inventive grid tee in a straight configuration.
Figure 9:
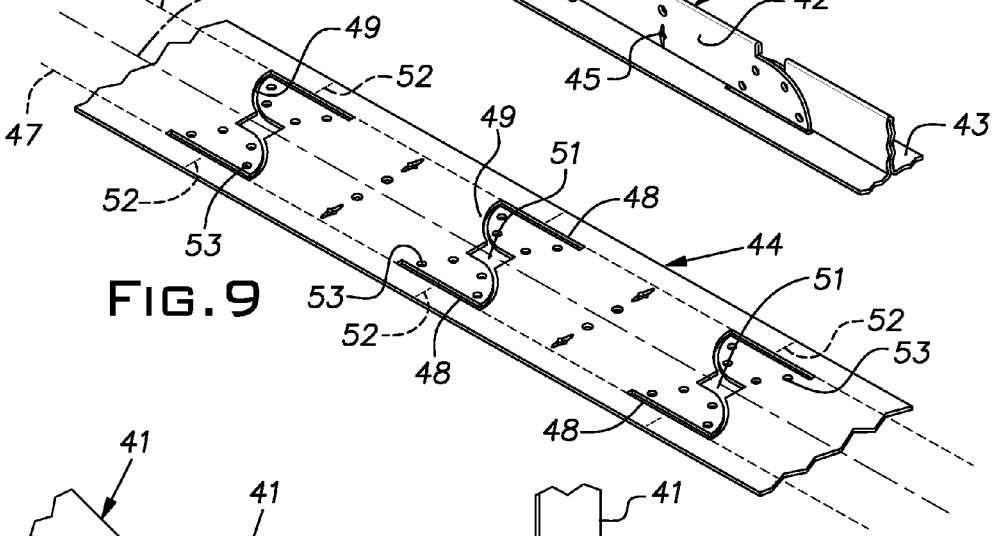
FIG. 9 is a fragmentary perspective view of a sheet metal blank with structural details of the tee of FIG. 8.
Figure 10A:
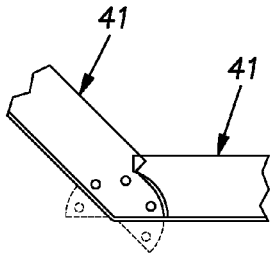
FIGS. 10A-D illustrate different configurations of the tee of FIG. 8.
Figure 10B:
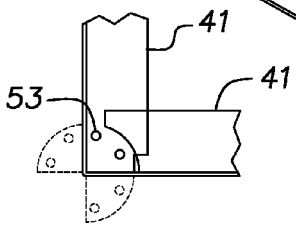
Figure 10C:
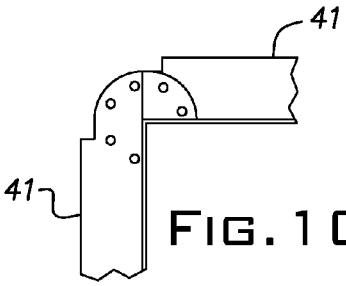
Figure 10D:
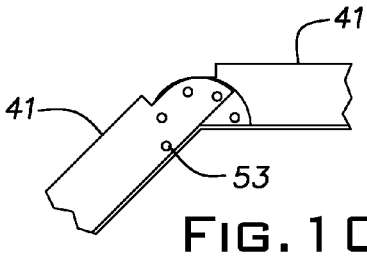

FIGS. 8-10 illustrate a second embodiment of the invention in which a curvable tee 40 has segments 41. Stems 42 of the segments 41 are severed from one another while flanges 43 of the segments 41 remain longitudinally continuous from segment-to-segment. The tee 40 is made from a single sheet metal blank 44, a short length of which is illustrated in FIG. 9. The blank 44 is formed with cross tee slots 45 and hanger holes 50. The blank 44 is folded 180 degrees on itself at a longitudinal centerline 46 to establish a double layer segment stem 42. The blank 44 is bent 90 degrees along lines 47 passing through longitudinally oriented slots 48 to create the oppositely extending flanges 43. Arcuate slots 49 connect between the longitudinal slots 48 and rectangular holes 51 along the centerline 46. The holes 51 separate adjacent segments 41.

The flange area in the blank 44 can be scored or notched transversely to the length of the blank 44 at lines 52 to assure that the tee 40 will bend along such lines when the tee 40 is bent in various configurations such as shown in FIGS. 10A-10D. Holes 53 punched in the blank 44 accept sheet metal screws to fix a selected angular orientation between adjacent segments 41 to produce a desired curve or angular configuration. The tee 40 is ideal for use in construction of soffits and like structures where drywall panels are to be erected at angles including right angles. Where the desired angle, measured across the face of the tee 40 is greater than 180 degrees, parts of the stems 42 that project through the slots 48 are trimmed as indicated by the broken lines in FIGS. 10A and 10B.

Figure 11:
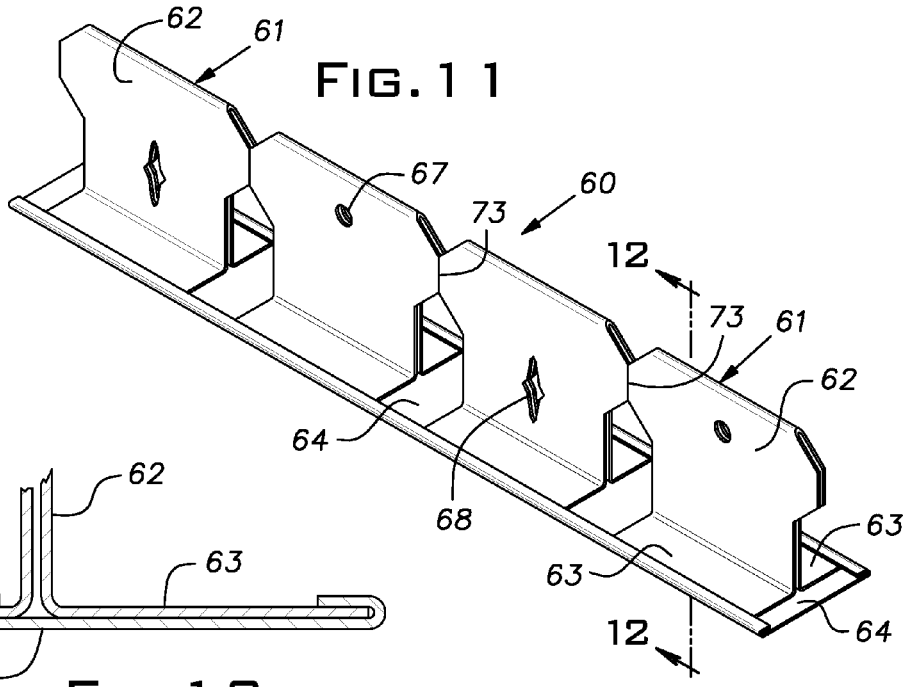
FIG. 11 is a fragmentary perspective view of a third embodiment of a grid tee of the invention.
Figure 12:
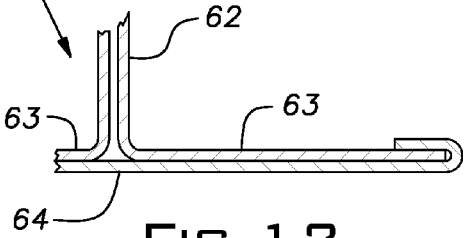
FIG. 12 is a fragmentary cross sectional view of the embodiment of FIG. 11.
Figure 13:
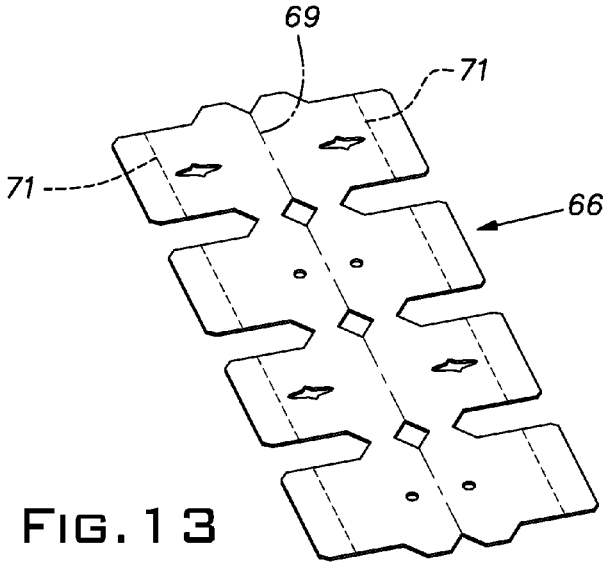
FIG. 13 is a fragmentary perspective view of a stamped metal sheet preform of segments of the tee of FIG. 11.

FIGS. 11-13 illustrate a curvable tee 60 in a third embodiment of the invention. The tee 60 has segments 61 each with a stem 62 and flanges 63. The segments 61 are unitary with one another. The tee 60, additionally, includes a flange face strip 64. FIG. 13 illustrates a fractional length of a blank 66 stamped from a strip of sheet metal from which the stem 62 and flanges 63 are formed. The blank 66 includes hanger wire receiving holes 67 and cross tee connector slots 68. The blank 66 is folded on itself at a centerline 69 to form the double layer segment stems 62 and bent at 90 degrees at the broken lines 71 to form opposed segmented flanges 63.

The flange face strip 64 extends continuously longitudinally along the full length of the tee 60. As shown in FIG. 12, the longitudinal margins of the face strip 64 are folded around distal edges of the flanges 63 in the manner of a hem to hold the strip on the flanges while allowing relative local slip between a segment 61 and the strip while maintaining the segments in a common vertical plane. The angular orientation of adjacent segments 61 in the vertical plane is adjusted by applying sufficient manual force to permanently stretch an upper region of a bridge area 73 between two segments, desired concave curvature of the tee 60 can be obtained. Conversely, if a convex curvature is desired, a manual force is applied to elongate a lower portion of the bridge area 73.

Drywall sheets can be secured to any of the illustrated curvable tees in the manner illustrated in FIG. 1. The drywall sheet, designated 75 is flexed so that it is tangent to the segments and is attached to such segments with self-drilling drywall screws 76 that penetrate any face strip and flanges of the respective tee.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A curvable grid tee for suspending drywall capable of being configured vertically into convex or concave shapes comprising a series of identical web segments joined end-to-end, the segments being formed of sheet metal into a tee shaped cross section, the sheet metal of a segment being folded such that each segment has a vertical stem with two stem layers joined at a common fold at upper edges thereof, the sheet metal at lower edges of each layer of the stem being bent outwardly to form a flange, a junction between adjacent segments permitting such adjacent segments to be angularly displaced relative to one another in a vertical plane such that the flanges are capable of supporting a drywall panel in a curved plane, the stems of adjacent segments being in overlapping direct contact through a full range of convex shapes up to a 90 degree bend and a full range of concave shapes up to a 90 degree bend when the tee is viewed from below whereby the stems of adjacent segments can be fixed relative to one another with the tee in a desired convex or concave configuration without use of a separate splice plate.

2. A curvable grid tee as set forth in claim 1, wherein said segments have vertical slots for receiving cross tee connectors and apertures for receiving suspension wires.

3. A curvable grid tee as set forth in claim 1, wherein said segments are structurally discontinuous from one another and adjacent ends of the segments are pivotally joined by a common pivot.

4. A curvable grid tee as set forth in claim 3, wherein said segments have arcuate ends concentric with a pivot center.

5. A curvable grid tee as set forth in claim 4, wherein each segment has a hole for receiving a locking screw adjacent a path described by an arcuate end when one segment pivots relative to the other.

6. A curvable tee for supporting drywall formed of a single strip of sheet metal folded lengthwise on a first line to form a stem with two overlapping layers and on second and third lines to form flanges extending in opposite directions from the stem, the strip being partially severed by an elongated severance selected from the group consisting of a slit, a slot, and combinations of a slit and a slot intermittently along said second and third lines and between said severance at said second and third lines at said first line in a manner providing adjacent segments and that allows said stem to be bent while the layers of adjacent segments remain overlapping at said flanges in a vertical plane from a straight line into any selected angle of 90 degrees up to 90 degrees down and be retained in the selected angle by securement of the double stem layers directly together adjacent the bend at said flange.

* * * * *